US011118739B2

(12) United States Patent
You et al.

(10) Patent No.: US 11,118,739 B2
(45) Date of Patent: Sep. 14, 2021

(54) LED FILAMENT LIGHT BULB APPARATUS

(71) Applicant: XIAMEN LEEDARSON LIGHTING CO., LTD, Xiamen (CN)

(72) Inventors: Yuankai You, Xiamen (CN); Xueqiong Chen, Xiamen (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 17/014,668

(22) Filed: Sep. 8, 2020

(65) Prior Publication Data

US 2021/0088189 A1 Mar. 25, 2021

(30) Foreign Application Priority Data

Sep. 20, 2019 (CN) ..... 201921576326.3

(51) Int. Cl.

| | |
|---|---|
| ***F21K 9/238*** | (2016.01) |
| ***F21S 4/24*** | (2016.01) |
| ***H05B 45/20*** | (2020.01) |
| ***F21Y 115/10*** | (2016.01) |

(52) U.S. Cl.

CPC ..... *F21K 9/238* (2016.08); *F21S 4/24* (2016.01); *H05B 45/20* (2020.01); *F21Y 2115/10* (2016.08)

(58) Field of Classification Search

CPC ..... F21K 9/238; F21S 4/24; H05B 45/20
USPC ..... 362/555
See application file for complete search history.

(56) References Cited

U.S. PATENT DOCUMENTS

| | | | | |
|---|---|---|---|---|
| 10,281,129 | B1 * | 5/2019 | Lai | H01R 33/22 |
| 10,690,292 | B1 * | 6/2020 | Cao | H05B 45/20 |
| 2011/0204777 | A1 * | 8/2011 | Lenk | F21V 23/04 315/32 |
| 2014/0327374 | A1 * | 11/2014 | McRae | F21K 9/20 315/291 |
| 2016/0041324 | A1 * | 2/2016 | Nava | F21K 9/61 362/311.01 |
| 2017/0012177 | A1 * | 1/2017 | Trottier | F21K 9/00 |

* cited by examiner

*Primary Examiner* — Bryon T Gyllstrom
(74) *Attorney, Agent, or Firm* — Chun-Ming Shih; Lanway IPR Services

(57) ABSTRACT

A flexible filament light bulb apparatus includes a first power wire, a second power wire, a first LED filament, a second LED filament, and a driver. A first end of the first LED filament is connected to the first power electrode. A fourth end of the second LED filament is connected to a second power electrode. The second end of the first LED filament is connected to the third end of the second LED filament. A driver is used for converting an external power source to a driving current supplied to the first power electrode and the second power electrode.

18 Claims, 6 Drawing Sheets

LED FILAMENT LIGHT BULB APPARATUS

FIELD

The present invention is related to a LED lighting apparatus, and more particularly related to a LED lighting apparatus with a bulb shell and adjustable function.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Light bulbs are popular among lighting devices. Since Edison provides the first well-known light bulb products, the world is changed by the luminance capability in the dark night and in the indoor environment.

Light bulbs also have revolutions changes when LED technologies are developed. However, to leverage the power of LED technologies, it is beneficial to find new design ways to use LED technologies to provide more powerful, more flexible and more valuable light bulb products. Light bulbs are popular among lighting devices. Since Edison provides the first well-known light bulb products, the world is changed by the luminance capability in the dark night and in the indoor environment.

Light bulbs also have revolutions changes when LED technologies are developed. However, to leverage the power of LED technologies, it is beneficial to find new design ways to use LED technologies to provide more powerful, more flexible and more valuable light bulb products. Light bulbs are popular among lighting devices. Since Edison provides the first well-known light bulb products, the world is changed by the luminance capability in the dark night and in the indoor environment.

Light bulbs also have revolutions changes when LED technologies are developed. However, to leverage the power of LED technologies, it is beneficial to find new design ways to use LED technologies to provide more powerful, more flexible and more valuable light bulb products. Light bulbs are popular among lighting devices. Since Edison provides the first well-known light bulb products, the world is changed by the luminance capability in the dark night and in the indoor environment.

Light bulbs also have revolutions changes when LED technologies are developed. However, to leverage the power of LED technologies, it is beneficial to find new design ways to use LED technologies to provide more powerful, more flexible and more valuable light bulb products.

SUMMARY

In some embodiments, a flexible filament light bulb apparatus includes a first power wire, a second power wire, a first LED filament, a second LED filament, and a driver.

The first power wire has a first electrode. The second power wire has a second electrode. The first LED filament has a first end and a second end.

The first end of the first LED filament is connected to the first power electrode. The second LED filament has a third end and a fourth end.

The fourth end of the second LED filament is connected to the second power electrode. The second end of the first LED filament is connected to the third end of the second LED filament.

The driver is used for converting an external power source to a driving current supplied to the first power electrode and the second power electrode.

The first power electrode and the second power electrode are placed at two sides of the second LED filament.

For example, when the second LED filament is bent as a spiral shape structure, there is an enclosing space defined by the spiral shape structure.

If the first LED filament and the second LED filament are connected in series without reserving a conductive path back to the same side to receive input and output terminals of a current, the first power wire is extended upwardly and disposed inside the spiral shape of the second LED shape to prevent shielding light of the second LED filament.

The external power source may be a 110V/220V alternating current. The driver may include a transformer, a filter, a rectifier and other components for converting the external power to a driving current, e.g. a direct current with lower voltage level suitable for powering a LED chip.

In some embodiments, the first LED filament and the second LED filament have a flexible substrate so that the first LED filament and the second LED filament are both able to be bent as needed shape, e.g. a arc shape or a spiral shape.

In some other embodiments, the second LED filament may have a flexible substrate while the first LED filament has a rigid substrate. Only the second LED filament is bendable. In such case, the first LED filament may also be used for keep the spiral shape or other bending shape of the second LED filament.

The first power wire and the second power wire may be made of metal material. The strength of the first power wire and the second power wire may be strong enough as a part of support bracket keep positions and bending angles of the first LED filament and the second LED filament.

In some embodiments, the flexible filament light bulb apparatus may also include a cap and a bulb shell.

The bulb shell encloses the first LED filament and the second LED filament.

The first LED filament and the second LED filament are bent with different patterns.

In some embodiments, the LED filament bulb apparatus may have a bulb shell and a bulb cap.

The bulb cap may be a standard Edison cap for connecting to a standard Edison socket.

In some embodiments, the first LED filament is bent as a convex curve shape facing toward a top side of the bulb shell.

In some embodiments, an antenna electrical connected to a wireless circuit of the driver is disposed on the first LED filament.

In some embodiments, the first LED filament has multiple LED modules on an exterior side of the convex curve shape.

In some embodiments, the second LED filament is bent as a spiral shape with a first radial direction in parallel with a second radial direction of the cap.

In some embodiments, a light strength per inch of the first LED filament is different from the second LED filament.

The first LED filament may have a relative stronger light strength per inch than the second LED filament so that people identify the first LED filament corresponding to a filament component in traditional light bulbs.

The second LED filament may provide an ambient light source, compared with the first LED filament to appear as a decoration part.

In some embodiments, the second end of the first LED filament is plugged to the third end of the second LED filament with a plugging structure.

There are various ways to implement the plugging structure. For example, one component has a protruding block even with a reverse hook. The other component has a socket for receiving and locking the protruding block.

Such design makes assembly process easier because no welding is needed to fix two components connected together.

In some embodiments, the first LED filament has a first LED strip and a second LED strip attached side by side to each other.

The second LED filament has a third LED strip and a fourth LED strip attached side by side to each other. The first LED strip is connected in series with the third LED strip. The second LED strip is connected to the fourth LED strip in series.

In some embodiments, each of the first LED filament and the second LED filament may have multiple LED strips.

In some other embodiments, in addition to the first LED filament and the second LED filament, there may be more than two LED filaments.

In some embodiments, the LED strips in one LED filament may be connected to corresponding LED strips on an adjacent LED filament. A common terminal for multiple LED strips in one LED filament may be used for connecting to LED strips on another LED filament.

In some embodiments, the LED strips may be controlled separately by providing an independent conductive path for each LED strip.

In some embodiments, the first LED strip and the third LED strip have lower color temperature than the second LED strip and the fourth LED strip.

In some embodiments, the first LED strip has the same color temperature as the third LED strip. The second LED strip has the same color temperature as the fourth LED strip.

In some embodiments, the driver controls a relative current ratio supplied to the third LED strip and the fourth LED strip to adjust an optical parameter of a mixed light.

For example, by adjusting the relative current supply, a mixed color temperature, a mixed color, a mixed color rendering index may be obtained.

In some embodiments, a lateral fluorescent layer is attached on a lateral side of the third LED strip and the fourth LED strip to emit a lateral light with a different color temperature as the first LED strip and the second LED strip.

Specifically, the first light from the first LED strip is further converted by the lateral fluorescent layer to have a different light parameter. It is the same for the second LED strip. Therefore, it is possible to use two LED strips to produce three optical parameters to be mixed to generate a desired optical parameter of output light.

In some embodiments, the third LED strip emits a first light with a first color temperature. The fourth LED strip emits a second light with a second color temperature. The driver controls a relative ratio among the first light. The second light and the lateral light to mix a mixed light with a needed color temperature.

In some embodiments, a vertical support extended from a column base keeps the second LED filament bent as a spiral shape. The spiral shape has a first radial direction in parallel to a third radial direction of the vertical support.

In some embodiments, the column base and a bulb shell are made of glass material and fixed together forming a concealed space. An air exit of the column is sealed after a heat dissipation gas is installed in the concealed space. The first LED filament and the second LED filament are enclosed in the concealed space.

In some embodiments, the first power wire and the second power wire have a portion being embedded in the column base. The first power wire and the second power wire have driver electrodes exposed outside the column base and connected to the driver.

In some embodiments, the vertical support has a first support bracket and a second support bracket. The first support bracket and the second support bracket are fixed to the vertical support. There are multiple support nodes on the first support bracket and the second support bracket for engaging the second LED filament to keep the spiral shape of the second LED filament.

In some embodiments, there are curved portion arranged on the first support bracket and the second bracket to protrude to engage and keep the second LED filament at positions serving as the support nodes.

In some other embodiments, the support nodes may be achieved by using glues, plugging structures or hook structures.

In some embodiments, the second LED filament bent as the spiral shape enclose a portion of the first power wire.

In some embodiments, the first power wire is extended upwardly and enclosed within the spiral shape of the second LED filament.

In some embodiments, the first LED filament and the second LED filament are controlled separately by the driver.

In some embodiments, the first filament and the second filament are connected in series and therefore receive the same current passing through to drive the LED modules in the first LED filament and the second LED filament to emit light.

In such case, when the current is increasing, both the first LED filament and the second LED filament increase their light strengths.

However, in some other embodiments, the first LED filament and the second LED filament may be added with switch elements or change their power paths connected to the driver so that the driver controls the first LED filament and the second LED filament separately.

In such case, the driver may control a relative ratio of light strengths between the first LED filament and the second LED filament to produce a mixed light of desired color temperature.

In some embodiments, there is a first switch on the first LED filament and a second switch on the second LED filament to control whether a current is passing by without powering LED modules on the first LED filament and the second LED filament or to power the LED modules on the first LED filament and the second LED filament separately.

DETAILED DESCRIPTION

Figure 6:
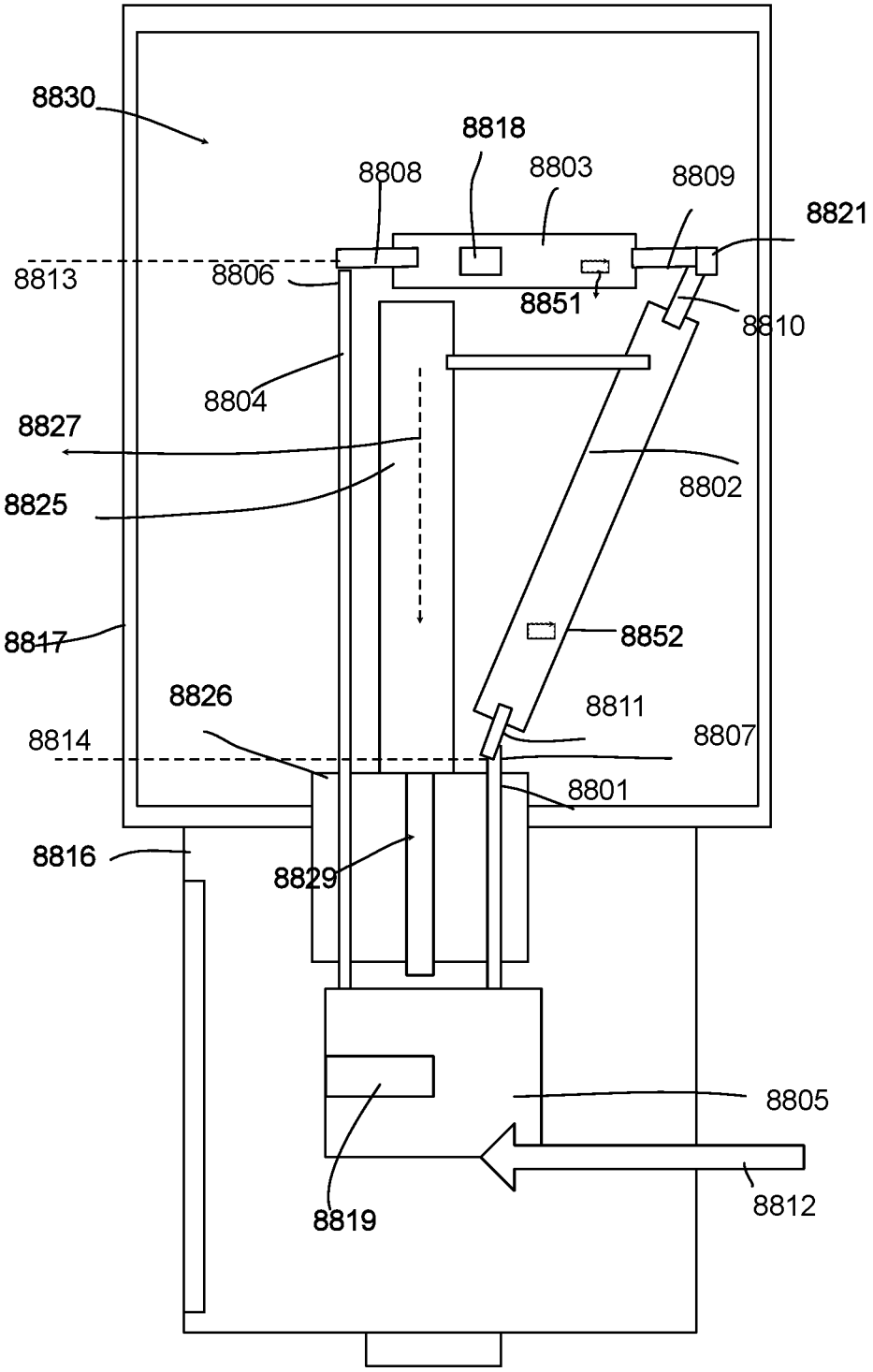
FIG. 6 illustrates a light bulb example.

In FIG. 6, a flexible filament light bulb apparatus includes a first power wire 8804, a second power wire 8801, a first LED filament 8803, a second LED filament 8802, and a driver 8805.

The first power wire 8804 has a first electrode 8806. The second power wire 8801 has a second electrode 8807. The first LED filament 8803 has a first end 8808 and a second end 8809.

The first end 8808 of the first LED filament 8803 is connected to the first power electrode 8806.

The second LED filament 8802 has a third end 8810 and a fourth end 8811.

The fourth end 8811 of the second LED filament 8802 is connected to the second power electrode 8801. The second end 8809 of the first LED filament 8803 is connected to the third end 8810 of the second LED filament 8802.

The driver 8805 is used for converting an external power source 8812 to a driving current supplied to the first power electrode 8806 and the second power electrode 8807.

The first power electrode 8806 and the second power electrode 8807 are placed at two sides 8813, 8814 of the second LED filament 8802.

For example, when the second LED filament 8802 is bent as a spiral shape structure, there is an enclosing space defined by the spiral shape structure. A clear example is provided in following description and drawings.

If the first LED filament and the second LED filament are connected in series without reserving a conductive path back to the same side to receive input and output terminals of a current, the first power wire is extended upwardly and disposed inside the spiral shape of the second LED shape to prevent shielding light of the second LED filament.

The external power source may be a 110V/220V alternating current. The driver may include a transformer, a filter, a rectifier and other components for converting the external power to a driving current, e.g. a direct current with lower voltage level suitable for powering a LED chip.

In some embodiments, the first LED filament and the second LED filament have a flexible substrate so that the first LED filament and the second LED filament are both able to be bent as needed shape, e.g. an arc shape or a spiral shape.

In some other embodiments, the second LED filament may have a flexible substrate while the first LED filament has a rigid substrate. Only the second LED filament is bendable. In such case, the first LED filament may also be used for keep the spiral shape or other bending shape of the second LED filament.

In some embodiments, the second LED filament or the first LED filament has a substrate and LED modules are disposed on both sides of the substrate.

In such design, a second fluorescent layer may be attached on the back side of the substrate that is not attached with LED modules. When the LED filament is bent, certain light may be emitted to such fluorescent layer and reflected to generate another light of a different optical parameter. In some light design, it is important to emit lights of multiple parameters for rendering a more complete light spectrum, or to emphasize certain types of objects.

In some embodiments, the second LED filament or the first LED filament has a transparent substrate, and the LED modules mounted on one side also emits certain amount of light to the back side of the substrate.

The first power wire and the second power wire may be made of metal material. The strength of the first power wire and the second power wire may be strong enough as a part of support bracket keep positions and bending angles of the first LED filament and the second LED filament.

In some embodiments, the flexible filament light bulb apparatus may also include a cap 8816 and a bulb shell 8817.

The bulb shell 8817 encloses the first LED filament 8803 and the second LED filament 8802.

The first LED filament 8803 and the second LED filament 8802 are bent with different patterns.

In some embodiments, the LED filament bulb apparatus may have a bulb shell and a bulb cap.

The bulb cap may be a standard Edison cap for connecting to a standard Edison socket.

In some embodiments, the first LED filament is bent as a convex curve shape facing toward a top side of the bulb shell.

In some embodiments, an antenna 8818 electrically connected to a wireless circuit 8819 of the driver 8805 is disposed on the first LED filament 8803.

Figure 2:
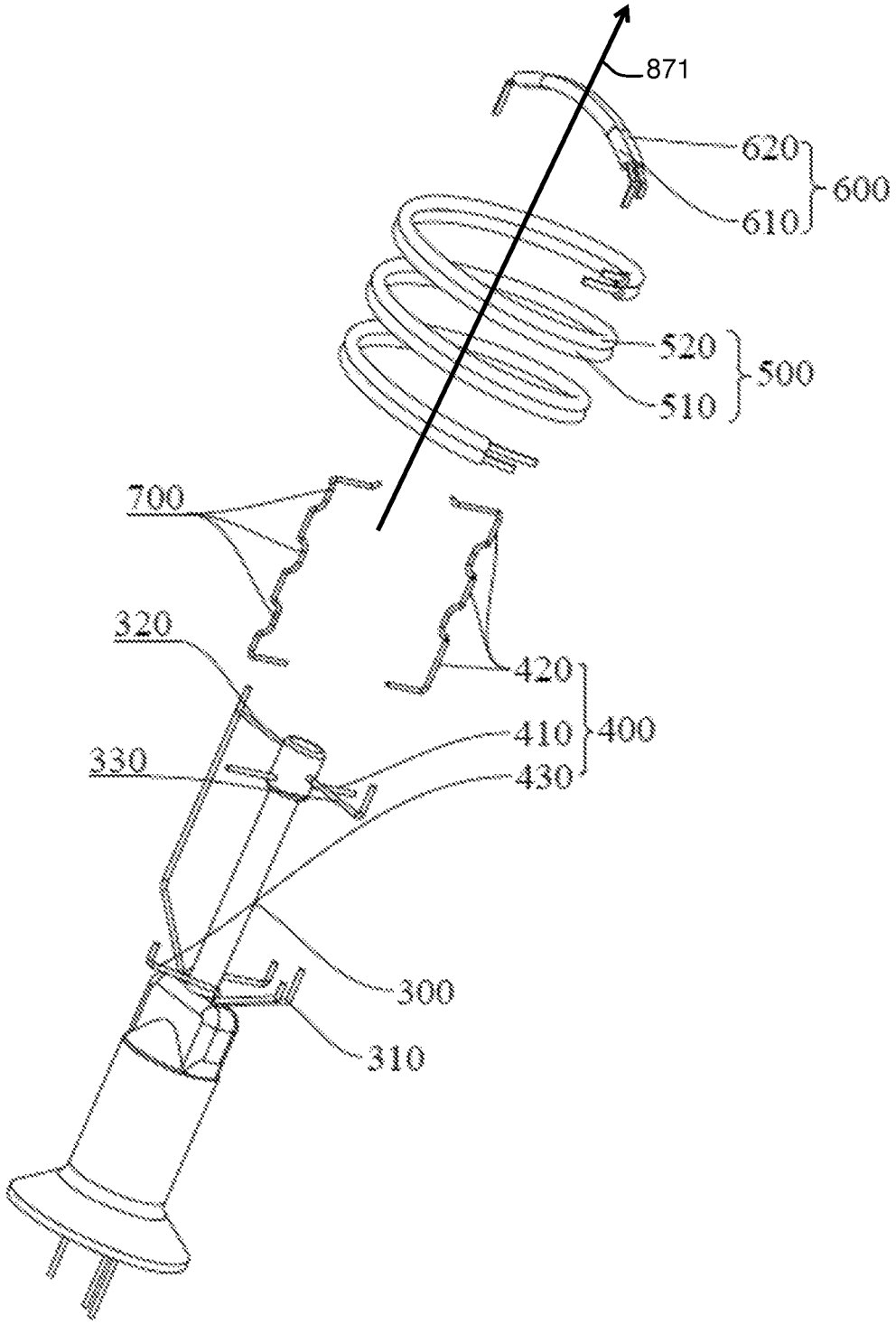
FIG. 2 illustrates another exploded view of the example in FIG. 1.

In some embodiments, the first LED filament has multiple LED modules on an exterior side of the convex curve shape. For example, FIG. 2 shows a first LED filament 600 with an arc shape with a convex curve shape facing to a top surface of a bulb shell. On the top side of the first LED filament 600, multiple LED modules (not directly shown) are disposed.

Figure 1:
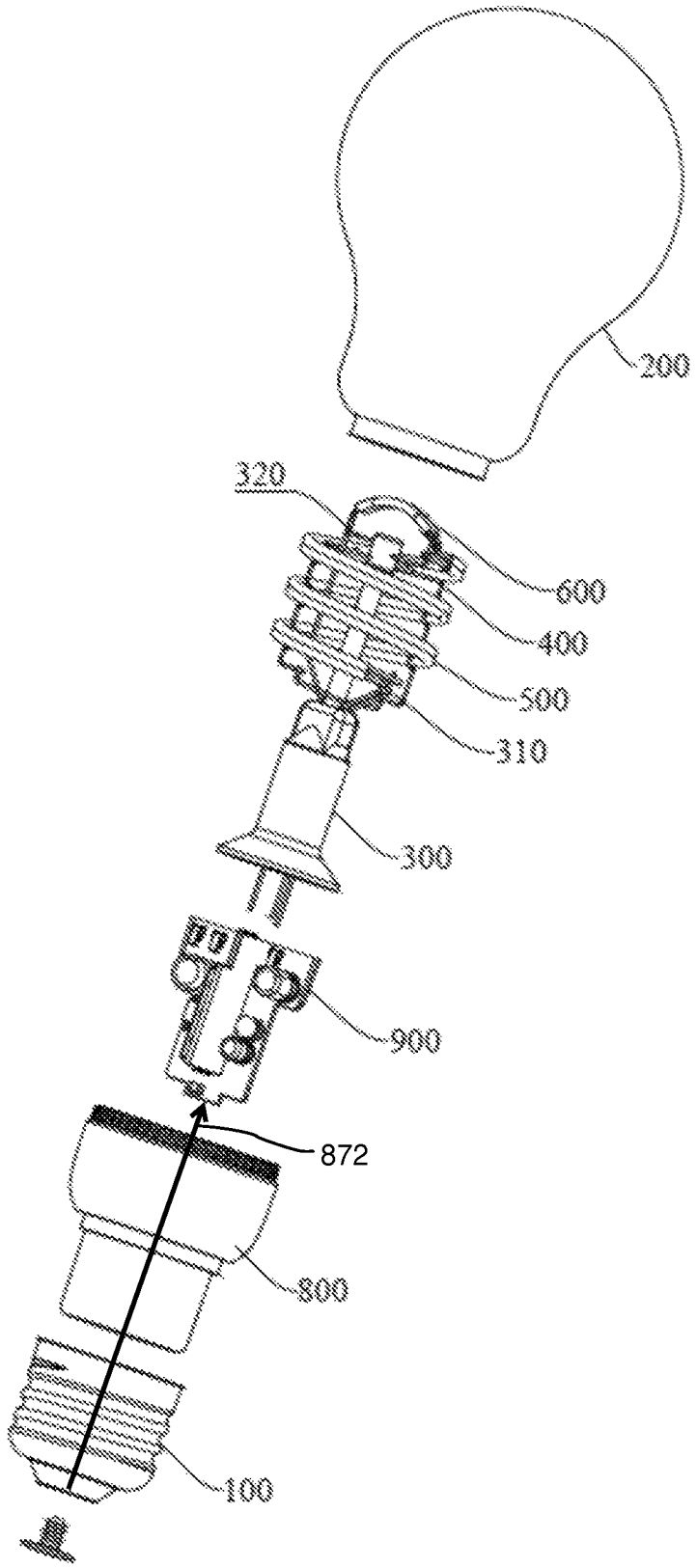
FIG. 1 illustrates an exploded view of a light bulb apparatus embodiment.

In FIG. 2, the second LED filament 500 is bent as a spiral shape with a first radial direction 871 in parallel with a second radial direction 872 of the cap 100 in FIG. 1.

In some embodiments, a light strength per inch of the first LED filament is different from the second LED filament. Specifically, more LED modules are disposed in a closer area increase the light strength per inch. Alternatively, using LED modules with higher luminance level, e.g. consumes more power, may provide higher light intensity per inch.

In some embodiments, the first LED filament has stronger light intensity than the second LED filament. In such case, the first LED filament is emphasized. In some other embodiments, the second LED filament may provide higher light intensity, so as to provide a stronger environment luminance.

Such relation may be adjusted by supplying different current levels to the first LED filament and the second LED filament.

In some embodiments, the first LED filament may have a relative stronger light strength per inch than the second LED filament so that people identify the first LED filament corresponding to a filament component in traditional light bulbs.

The second LED filament may provide an ambient light source, compared with the first LED filament to appear as a decoration part.

In FIG. 6, the second end of the first LED filament is plugged to the third end of the second LED filament with a plugging structure 8821.

There are various ways to implement the plugging structure. For example, one component has a protruding block even with a reverse hook. The other component has a socket for receiving and locking the protruding block.

Such design makes assembly process easier because no welding is needed to fix two components connected together.

In FIG. 2, the first LED filament 600 has a first LED strip 610 and a second LED strip 620 attached side by side to each other.

The second LED filament 500 has a third LED strip 510 and a fourth LED strip 520 attached side by side to each other. The first LED strip 610 is connected in series with the third LED strip 510. The second LED strip 620 is connected to the fourth LED strip 520 in series.

In some embodiments, each of the first LED filament and the second LED filament may have multiple LED strips.

In some other embodiments, in addition to the first LED filament and the second LED filament, there may be more than two LED filaments.

In some embodiments, the LED strips in one LED filament may be connected to corresponding LED strips on an adjacent LED filament. A common terminal for multiple LED strips in one LED filament may be used for connecting to LED strips on another LED filament.

In some embodiments, the LED strips may be controlled separately by providing an independent conductive path for each LED strip.

In some embodiments, the first LED strip and the third LED strip have lower color temperature than the second LED strip and the fourth LED strip.

In some embodiments, the first LED strip has the same color temperature as the third LED strip. The second LED strip has the same color temperature as the fourth LED strip.

In some embodiments, the driver controls a relative current ratio supplied to the third LED strip and the fourth LED strip to adjust an optical parameter of a mixed light.

For example, by adjusting the relative current supply, a mixed color temperature, a mixed color, a mixed color rendering index may be obtained.

Figure 7:
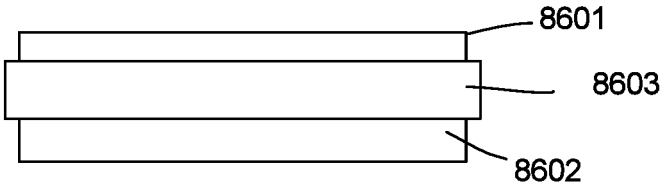
FIG. 7 shows a lateral fluorescent layer applied on lateral sides of two LED strips.

In FIG. 7, a lateral fluorescent layer 8603 is attached on a lateral side of the third LED strip 8601 and the fourth LED strip 8602 to emit a lateral light with a different color temperature as the first LED strip and the second LED strip.

Specifically, the first light from the first LED strip is further converted by the lateral fluorescent layer to have a different light parameter. It is the same for the second LED strip. Therefore, it is possible to use two LED strips to produce three optical parameters to be mixed to generate a desired optical parameter of output light.

In some embodiments, the third LED strip emits a first light with a first color temperature. The fourth LED strip emits a second light with a second color temperature. The driver controls a relative ratio among the first light. The second light and the lateral light to mix a mixed light with a needed color temperature.

In some embodiments, a vertical support 8825 extended from a column base 8826 keeps the second LED filament bent as a spiral shape. The spiral shape has a first radial direction in parallel to a third radial direction 8827 of the vertical support 8825.

In some embodiments, the column base and a bulb shell are made of glass material and fixed together forming a concealed space. An air exit 8829 of the column base 8826 is sealed after a heat dissipation gas is installed in the concealed space. The first LED filament and the second LED filament are enclosed in the concealed space 8830.

Heat dissipation gas like He mixed with 10% more Oxygen is tested as a great solution for increasing the life span of the lighting apparatus. Other heat dissipation gas may be filled in some embodiments.

In some embodiments, the first power wire and the second power wire have a portion being embedded in the column base. The first power wire and the second power wire have driver electrodes exposed outside the column base and connected to the driver. It is clearly illustrated in FIG. 6, where the first power wire 8804 has a portion embedded in the column base 8826.

In FIG. 2, the vertical support has a first support bracket 420 and a second support bracket 700. The first support bracket 420 and the second support bracket 700 are fixed to the vertical support 300. There are multiple support nodes (the convex or concave part) on the first support bracket 420 and the second support bracket 700 for engaging the second LED filament 500 to keep the spiral shape of the second LED filament.

In some embodiments, there are curved portion arranged on the first support bracket and the second bracket to protrude to engage and keep the second LED filament at positions serving as the support nodes.

In some other embodiments, the support nodes may be achieved by using glues, plugging structures or hook structures.

In some embodiments, the second LED filament bent as the spiral shape enclose a portion of the first power wire.

In some embodiments, the first power wire is extended upwardly and enclosed within the spiral shape of the second LED filament.

In some embodiments, the first LED filament and the second LED filament are controlled separately by the driver.

In some embodiments, the first filament and the second filament are connected in series and therefore receive the same current passing through to drive the LED modules in the first LED filament and the second LED filament to emit light.

In such case, when the current is increasing, both the first LED filament and the second LED filament increase their light strengths.

However, in some other embodiments, the first LED filament and the second LED filament may be added with switch elements or change their power paths connected to the driver so that the driver controls the first LED filament and the second LED filament separately.

In such case, the driver may control a relative ratio of light strengths between the first LED filament and the second LED filament to produce a mixed light of desired color temperature.

In FIG. 6, there is a first switch 8851 on the first LED filament and a second switch 8852 on the second LED filament to control whether a current is passing by without powering LED modules on the first LED filament and the second LED filament or to power the LED modules on the first LED filament and the second LED filament separately.

Please refer to FIG. 1, which illustrates an embodiment of a light bulb apparatus.

In FIG. 1, a bulb shell 200 encloses first LED filament 600 and a second LED filament 500. A bracket 400 is used for fixing the first LED filament 600 and the second LED filament 500. There is a first power wire 320 and a second power wire 310 for providing electricity and connected to the first LED filament 600 and the second LED filament 500.

There is a column base 300 which may be made of glass material and are connected to the bulb shell 200. A driver is electrically connected to the first LED filament 600 and the second LED filament 500 via the first power wire 320 and the second power wire 310. A portion of the first power wire 320 and the second power wire 310 are embedded inside the column base 300.

A heat sink 800 helps carry heat of the LED modules of the first LED filament 600 and the second LED filament 500 away to increase life span of the light bulb apparatus.

There is a cap 100 with a lateral terminal and a bottom terminal for receiving an external power source.

Please refer to FIG. 2. In FIG. 2, a first LED filament 600 has a first LED strip 610 and a second LED strip 620. The first LED strip 610 may have a color temperature higher than the second LED strip 620. The first LED strip 610 and the second LED strip 620 are placed side by side.

Similarly, the second LED filament 500 has a third LED strip 510 and a fourth LED strip 520. The third LED strip 510 and the fourth LED strip 520 may have different color temperatures.

Two brackets 700, 420 are placed at two sides of the vertical support 300. There are supporting levers 330 and connectors 410, 430 for fixing components of the light bulb apparatus.

The first power wire 320 is fixed to the vertical support 300 in this example. The second power 310 is also fixed to the vertical support 300 in this example.

Figure 3:
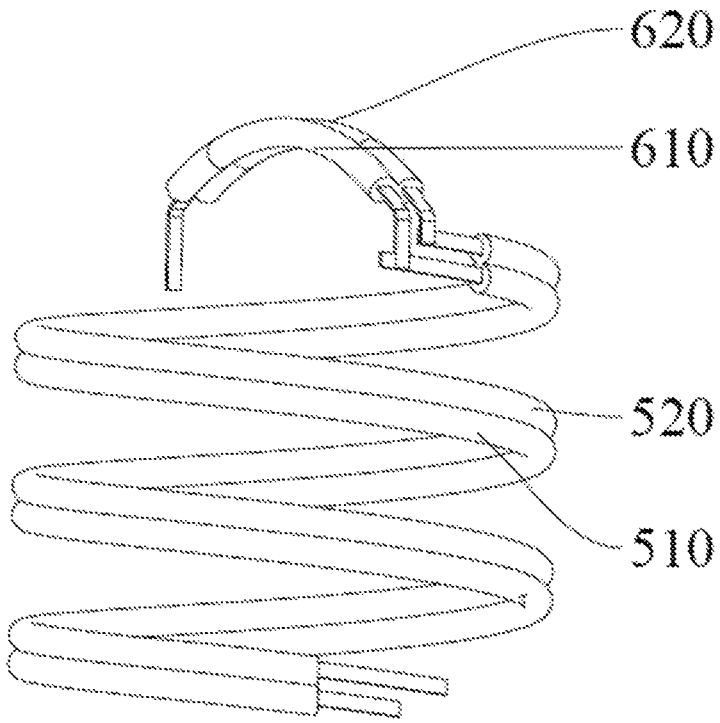
FIG. 3 illustrates a zoom-up view of a light source component.

FIG. 3 show a zoom-up view of the LED strips and the LED filaments. The same reference numerals refer to the same components mentioned above and are not repeated for brevity.

Figure 4:
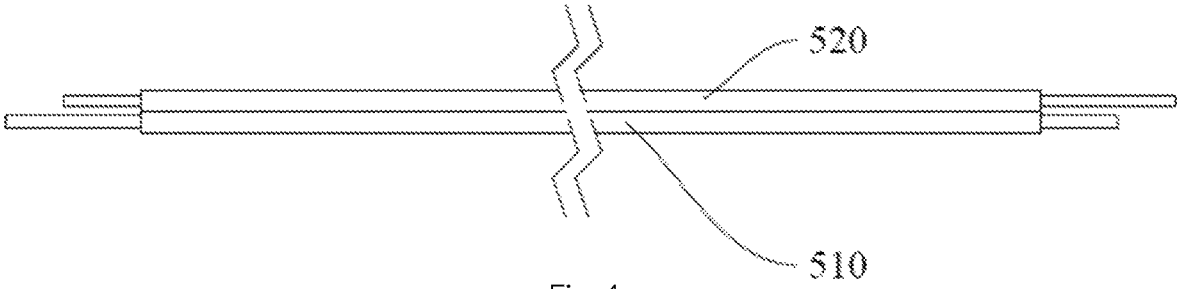
FIG. 4 illustrates an example of a LED filament component.
Figure 5:
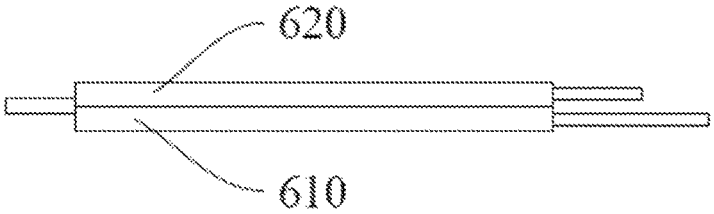
FIG. 5 illustrates another example of a LED filament component.

FIG. 4 and FIG. 5 show another view of the LED strips 520, 510, 620, 610. In FIG. 5, there is a common end for the LED strips 610, 620.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A flexible filament light bulb apparatus comprising:

a first power wire having a first electrode;

a second power wire having a second electrode;

a first LED filament having a first end and a second end, wherein the first end of the first LED filament is connected to the first power electrode;

a second LED filament having a third end and a fourth end, wherein the fourth end of the second LED filament is connected to the second power electrode, the second end of the first LED filament is connected to the third end of the second LED filament;

a driver for converting an external power source to a driving current supplied to the first power electrode and the second power electrode, wherein the first power electrode and the second power electrode are placed at two sides of the second LED filament; and a cap and a bulb shell, wherein the bulb shell encloses the first LED filament and the second LED filament, wherein the first LED filament and the second LED filament are bent with different patterns, wherein the second LED filament is bent as a spiral shape with a first radial direction in parallel with a second radial direction of the cap.

2. The flexible filament light bulb apparatus of claim 1, wherein the first LED filament is bent as a convex curve shape facing toward a top side of the bulb shell.

3. The flexible filament light bulb apparatus of claim 2, wherein an antenna electrical connected to a wireless circuit of the driver is disposed on the first LED filament.

4. The flexible filament light bulb apparatus of claim 2, wherein the first LED filament has multiple LED modules on an exterior side of the convex curve shape.

5. The flexible filament light bulb apparatus of claim 1, wherein a light strength per inch of the first LED filament is different from the second LED filament.

6. The flexible filament light bulb apparatus of claim 1, wherein the second end of the first LED filament is plugged to the third end of the second LED filament with a plugging structure.

7. The flexible filament light bulb apparatus of claim 1, wherein the first LED filament has a first LED strip and a second LED strip attached side by side to each other, the second LED filament has a third LED strip and a fourth LED strip attached side by side to each other, the first LED strip is connected in series with the third LED strip, the second LED strip is connected to the fourth LED strip in series.

8. The flexible filament light bulb apparatus of claim 7, wherein the first LED strip and the third LED strip have lower color temperature than the second LED strip and the fourth LED strip.

9. The flexible filament light bulb apparatus of claim 7, wherein the driver controls a relative current ratio supplied to the third LED strip and the fourth LED strip to adjust an optical parameter of a mixed light.

10. The flexible filament light bulb apparatus of claim 7, wherein a lateral fluorescent layer is attached on a lateral side of the third LED strip and the fourth LED strip to emit a lateral light with a different color temperature as the first LED strip and the second LED strip.

11. The flexible filament light bulb apparatus of claim 10, wherein the third LED strip emits a first light with a first color temperature, the fourth LED strip emits a second light with a second color temperature, the driver controls a relative ratio among the first light, the second light and the lateral light to mix a mixed light with a needed color temperature.

12. The flexible filament light bulb apparatus of claim 1, wherein a vertical support extended from a column base keeps the second LED filament bent as a spiral shape, the spiral shape has a first radial direction in parallel to a third radial direction of the vertical support.

13. The flexible filament light bulb apparatus of claim 12, wherein the column base and a bulb shell are made of glass material and fixed together forming an concealed space, an air exit of the column is sealed after a heat dissipation gas is installed in the concealed space, the first LED filament and the second LED filament are enclosed in the concealed space.

14. The flexible filament light bulb apparatus of claim 13, wherein the first power wire and the second power wire have a portion being embedded in the column base, the first power wire and the second power wire have driver electrodes exposed outside the column base and connected to the driver.

15. The flexible filament light bulb apparatus of claim 12, wherein the vertical support has a first support bracket and a second support bracket, the first support bracket and the second support bracket are fixed to the vertical support, there are multiple support nodes on the first support bracket and the second support bracket for engaging the second LED filament to keep the spiral shape of the second LED filament.

16. The flexible filament light bulb apparatus of claim 12, wherein the second LED filament bent as the spiral shape enclose a portion of the first power wire.

17. The flexible filament light bulb apparatus of claim 1, wherein the first LED filament and the second LED filament are controlled separately by the driver.

18. The flexible filament light bulb apparatus of claim 17, wherein there is a first switch on the first LED filament and a second switch on the second LED filament to control whether a current is passing by without powering LED modules on the first LED filament and the second LED filament or to power the LED modules on the first LED filament and the second LED filament separately.

* * * * *